United States Patent [19]

Bonnema et al.

[11] Patent Number: 4,726,490

[45] Date of Patent: Feb. 23, 1988

[54] SAFETY LID

[75] Inventors: Eldon G. Bonnema, Prinsburg, Minn.; Donald J. Smith, Fremont, Ohio

[73] Assignee: Prinsburg Tile Co., Inc., Prinsburg, Minn.

[21] Appl. No.: 904,477

[22] Filed: Sep. 8, 1986

[51] Int. Cl.[4] ..... B65D 43/10

[52] U.S. Cl. ..... 220/307; 220/18

[58] Field of Search ..... 220/307, 326, 18, DIG. 19, 220/306

[56] References Cited

U.S. PATENT DOCUMENTS

| | | | |
|---|---|---|---|
| 2,281,103 | 4/1942 | MacDonald | 220/326 |
| 3,666,338 | 5/1972 | Russell | 220/326 |
| 4,061,241 | 12/1977 | Retelny | 220/306 |

*Primary Examiner*—Stephen Marcus
*Assistant Examiner*—Nova Stucker
*Attorney, Agent, or Firm*—Emch, Schaffer, Schaub & Porcello Co.

[57] ABSTRACT

The invention is directed to a safety lid that can be used with a container. The container has a collection cavity having an opening on one end. A shoulder is located in the container adjacent the opening and the shoulder extends around at least a portion of the periphery of the container. The shoulder is disposed to be substantially parallel to the opening. At least one aperture is positioned in the periphery of the container adjacent the opening. A lid is positioned in said opening to close the container. The outer periphery of the lid substantially conforms to the periphery of the opening and the lid engages in and is supported by the shoulder. At least one lug is positioned on the outer periphery of the lid and the lug is disposed to be in alignment with and to extend through the aperture in the periphery of the container. The lug engages the side of the container to prevent the lid from tipping.

6 Claims, 6 Drawing Figures

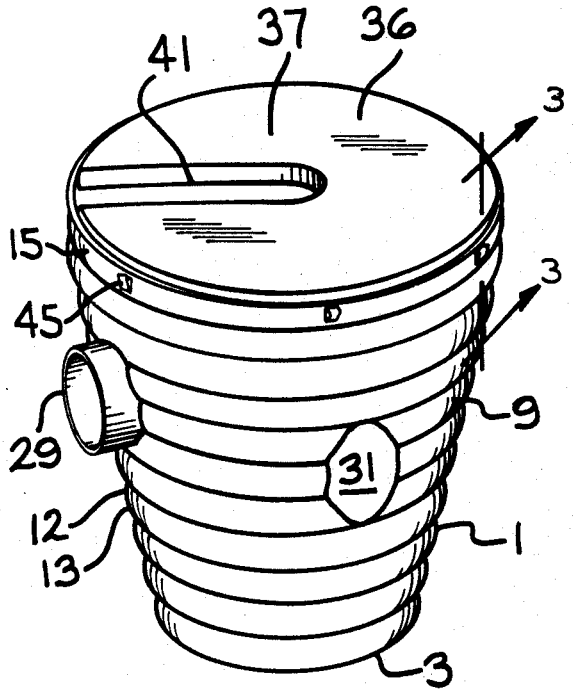
FIG. 1
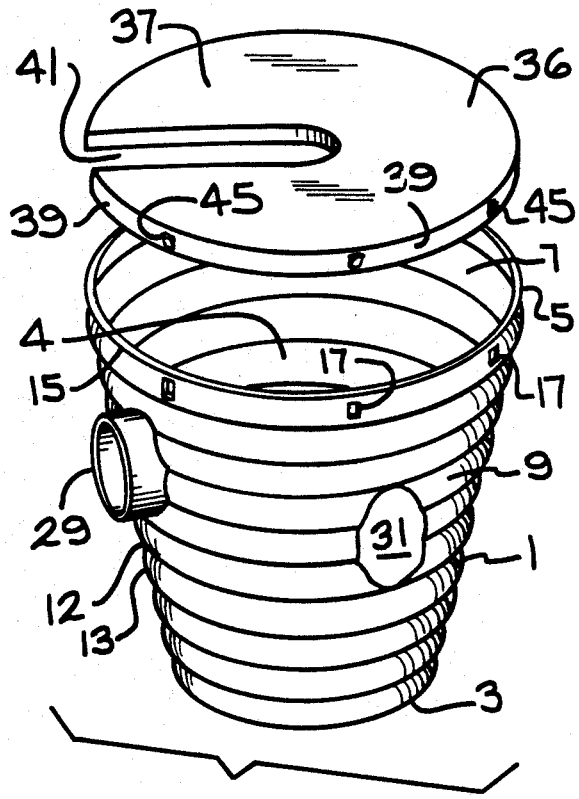
FIG. 2
FIG. 3
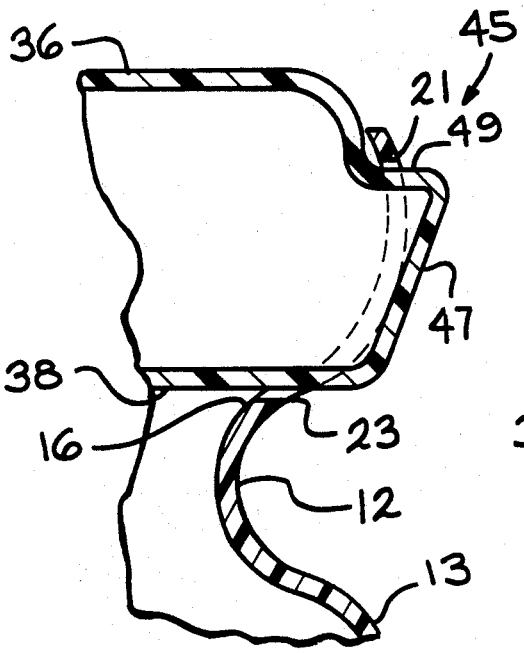
FIG. 4
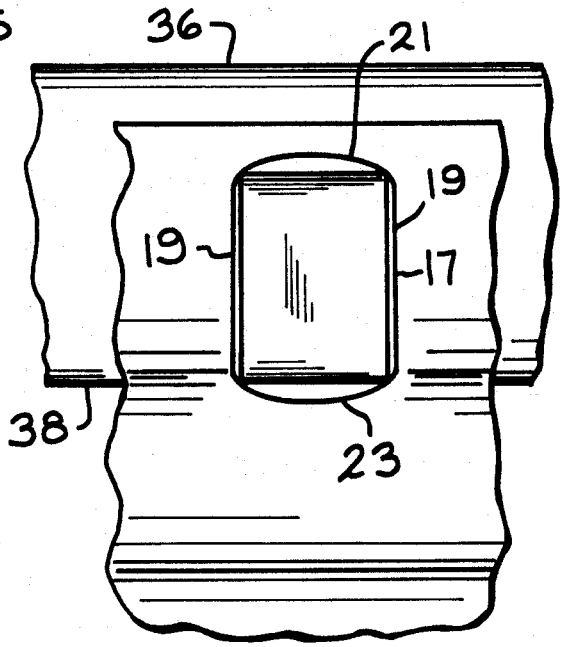

SAFETY LID

BACKGROUND OF THE INVENTION

The invention is directed to a lid or cover that can be used on a container. More particularly, the lid has built-in safety features to prevent the lid from tipping or being easily removed from the container. The lid is particularly useful in applications where someone may possibly be standing on the lid such as in a sump well.

Sump wells have been in use in this country for many years to collect ground water so that the ground water may be discharged into a storm sewer. In many communities there is now a provision in the building codes that require houses to have a sump well located in the basement or crawl space to collect excess ground water. This provision has been put into the building codes to ensure that the ground water is directed to a storm sewer and does not end up in the sanitary sewer system. In many communities where the sanitary and storm sewer systems are combined, it is impossible for the sewage treatment facilities to keep up with the quantity of water that is processed through the sewage treatment plant after a heavy rainfall. This is because all of the ground water from the rainfall is also directed through the sewage treatment plant. This results in an overflow condition where a great quantity of the water cannot be processed and a great deal of unprocessed sewage is discharged from the sewage treatment plant. This is a health and environmental problem that communities are trying to avoid. By requiring a sump well, communities have been able to ensure that the ground water, in at least newer construction, is not funneled into the sanitary sewer system.

A sump well is a container that is positioned in the floor of the basement. the sump well has a collection cavity where the ground water or rain water can be collected and then discharged from the sump well into the storm sewer. Frequently, a sump pump is positioned in the sump well to pump the water from the sump well into the storm sewer system. The top of the sump well is usually positioned at about the same level as the floor in the basement of the building. As a safety precaution to keep people from failing into the sump well and also to keep extraneous material from entering the sump well, a cover is placed over the open end of the sump well. Normally, the cover just rests on a shoulder or retaining device that is positioned in the sump well. However, there is a possibility of injuries resulting from this type of cover as it is possible for this cover to tip when an unbalanced load is positioned on the cover. Accordingly, if someone ends up standing on one side of the cover, it is possible for the whole cover or lid to tip resulting in the person falling into the sump well or onto the basement floor. Obviously, it is desirable to avoid such dangerous situations. There have also been occasions when children have been able to cause the lid or cover of the sump well to tip and the child has fallen into the sump well. If there is a sufficient quantity of water in the sump well, it is even possible for a child to drown as a result of such an accident. Accordingly, it is certainly desirable to have a cover or lid for a sump well that essentially eliminates the tipping problem.

It is also desirable to have a lid or cover for the sump well that is not easily removed or accidentially displaced by children that may be playing in the area of the sump well. If the lid has been displaced from the sump well, it is again easy for someone to step into the sump well and fall. Thus, it is desirable to have a lid or cover for the sump well that cannot be easily removed or displaced by unauthorized persons or children.

Accordingly, it is the object of the invention to provide an improved safety lid or cover.

It is also an object of the invention to provide a lid or cover that reduces or eliminates tipping of the lid.

It is a further object of the invention to provide a lid or cover that cannot easily be removed or displaced by unauthorized persons.

These and other objects and advantages of the invention will be more readily understood by referring to the attached drawings in connection with the following description.

SUMMARY OF THE INVENTION

The invention is directed to a safety lid that can be used with a container. The container has a collection cavity having an opening on one end. A shoulder is located in the container adjacent the opening and the shoulder extends around at least a portion of the periphery of the container. The shoulder is disposed to be substantially parallel to the opening. At least one aperture is positioned in the periphery of the container adjacent the opening. A lid is positioned in said opening to close the container. The outer periphery of the lid substantially conforms to the periphery of the opening and the lid engages in and is supported by the shoulder. At least one lug is positioned on the outer periphery of the lid and the lug is disposed to be in alignment with and to extend through the aperture in the periphery of the container. The lug engages the side of the container adjacent the aperture to prevent the lid from tipping.

BRIEF DESCRIPTION OF THE DRAWINGS

FIG. 1 is a perspective view of the safety lid of the present invention.

FIG. 2 is a perspective view of the invention.

FIG. 3 is a cross-sectional view taken along lines 3—3 in FIG. 1.

FIG. 4 is a partial side elevation view of a portion of the safety lid of the present invention.

DESCRIPTION OF THE PREFERRED EMBODIMENT

Figure 5:
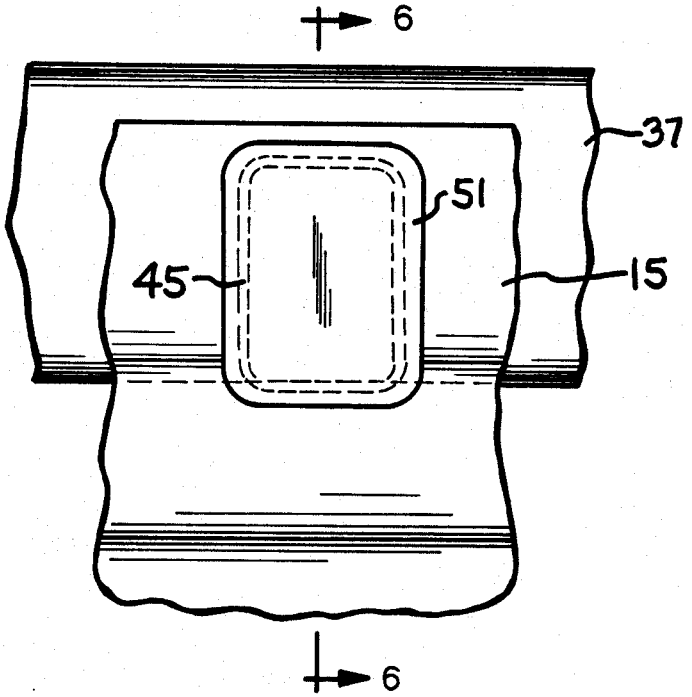
FIG. 5 is a partial side elevation view of a portion of another embodiment of the safety lid.

The invention is directed to a lid or cover that can be used on a container. More particularly, the invention is directed to a cover having lugs around its periphery where the lugs extend through apertures in the container to prevent the lid from tipping. This lid is particularly useful on sump wells. To facilitate the explanation of the invention the safety lid will be described as being used on a sump well. However, it should be understood that other applications for the safety lid are also possible and that the safety lid can be used anywhere it is desirable to have a lid that resists tipping and is difficult to accidentially remove. To better understand the features and advantages of the invention reference should be made to the attached drawings in connection with the following description.

The sump well 1 is a substantially cylindrical container having a first end 3 and a second end 5. The first end 3 of the sump well is closed and the second end 5 defines an opening 7. The opening 7 extends across substantially the entire second end of the sump well 1 and is substantially circular in configuration. it should be noted that other shapes for the opening 7 can be used without departing from the invention. The cylindrical wall 9 of the sump well 1 extends from the first end 3 to the second end 5 of the sump well and defines a collection cavity 4. The wall 9 gradually diverges or increases in diameter when advancing along the wall 9 from the first end 3 in a direction towards the second end 5. This allows the sump wells to be more readily stacked for shipping and storage. The cylindrical wall 9 of the sump well 1 is comprised of a plurality of ridges 13 and valleys 12 with adjacent ridges being separated by a valley. A portion of a ridge is positioned adjacent the opening 7 in the second end 5 of the sump well 1 and forms a ring 15 around the second end 5. The valley 12 adjacent the ring 15 forms a shoulder 16 that extends into the interior of the collection cavity. The shoulder 16 has a diameter that is smaller than the diameter of the ring 15. A plurality of apertures 17 pass through the ring 15 and the apertures are radially spaced around the second end 5 of the sump well 1. Usually, the apertures are spaced a substantially uniform distance apart around the periphery of the ring 15. The apertures 17 are substantially rectangular in shape having opposed substantially parallel sidewalls 19, a top wall 21 and a bottom wall 23. The top wall 21 and bottom wall 23 are in opposed substantially parallel relationship. Although a plurality of apertures 17 have been shown, in practice it has been found that four apertures, spaced uniformly apart on the periphery of the ring works satisfactory.

Positioned on the wall 9 is at least one inlet conduit 29. At least one plug section 31 is also positioned on the cylindrical wall 9 in spaced apart relationship with the inlet conduit 29. The plug section 31 can be cut out of the wall 9 to provide an additional passageway into the interior of the sump well 1. The inlet conduit 29 and the plug section 31 provide a means whereby fluid can be introduced into the collection cavity 4 formed by the sump well 1.

A lid 37 can be positioned on the second end 5 of the sump well 1 close the opening 7 in the sump well. The lid 37 is designed to conformed to the shape of the opening 7 as defined by the ring 15 at the second end 5 of the sump well 1. For the sump well shown in the drawings the lid 37 is substantially circular in shape to conform to the shape of the opening 7 and the lid has a diameter that is slightly smaller than the diameter of the ring 15. The diameter of the lid, is however, larger than the diameter of the shoulder 16. The lid has a thickness that is slightly greater than the height of the ring 15. The lid has a top surface 36 and a bottom surface 38. The top surface is spaced apart from the collection cavity 4 and the bottom surface is disposed adjacent the collection cavity. An end wall 39 extends around the outer periphery of the lid 37. A substantially U-shaped access channel 41 is positioned in the lid 37. The access channel 41 extends from the outer periphery of the lid to substantially the center of the lid. Positioned on the end wall 39 are a plurality of lugs 45. The lugs extend from the end wall 39 in a direction away from the end wall. The lugs 45 are positioned so that they are in alignment with the apertures 17 located on the ring 15 of the sump well 1. Although a plurality of lugs are shown, practice it has been found that four lugs cooperating with four apertures 17 work satisfactorily. The lugs 45 have a cam surface 47 that is positioned on the portion of the lugs 45 that is spaced apart from the end wall 39. The cam surface 47 is disposed at an angle with respect to the end wall 39 so that the cam surface diverges outwardly as the cam surface advances towards the top surface 36 of the lid 37. The cam surface 47 terminates at a sill 49 that extends back to the end wall 39 of the lid 37. The sill 49 is disposed substantially parallel to the top surface of the lid 37. The lugs 45 are slightly smaller than the apertures 17 formed in the ring 15 so that the lugs can extend through the apertures 17. The sill 49 is disposed to engage the top wall 21 of the apertures 17.

In operation the sump well 1 is positioned so that ground water or other liquids can enter the collection cavity through the inlet conduit 29 or the plug section 31. The liquid or fluid that is collected is normally pumped out of the collection cavity of the sump well 1 by the use of a sump pump or other similar pumping device. Normally, the fluid is discharged from the sump well 1 through the access channel 41 that is located in the lid 37. The lid 37 is positioned on the sump well 1 to cover the collection cavity 4 and to close the opening 7 to prevent any person or undesirable material from entering the sump well through the opening.

As the lid 37 is positioned on the second end 5 of the sump well 1, the cam surface 47 of the lugs 45 will engage the ring 15. The cam surfaces 47 on the lugs 45 causes the ring 15 to expand radially outwardly as the lid 37 is advanced towards the first end 3 of the sump well. The cam surfaces cause the ring 15 continue to expand radially until the lugs 45 are in alignment with the aperture 17. When the lid is in the proper position the lugs extend through the apertures 17 and the ring 15 can return to its original shape. With the lugs 45 positioned in the apertures 17, the sill 49 of the lugs engages the top wall 21 of the apertures 17. When the lugs 45 are in alignment with the apertures 17, the lid 37 is in contact with the shoulder 16. The shoulder 16 prevents the lid from advancing any further towards the first end 3 of the sump well 1 and provides support to maintain the lid 37 in the desired position. Thus, it is important that the shoulder 16, lugs 45 and apertures 17 be properly positioned so that the lugs are in alignment with the apertures when the lid is positioned on the shoulder 16.

The lugs 45 are essential to maintain the lid in position on the sump well 1. Sump wells are frequently positioned in a submerged manner, with the second end 5 at floor level, as in a basement, and this results in the lid 37 also being located at floor level. Accordingly, it is easy to inadvertantly end up standing on one side of the lid 37. In this unbalanced condition it is easy for a lid without the lugs 45 to tip and for a person to fall into the sump well or otherwise be injured. The shoulder 16 does not restrain the movement of the lid to prevent tipping. This is particularly a problem when children have access to the area where the sump well is located. With the present invention the lugs 45 are positioned in the apertures 17 and the sills 49 engage the top wall 21 of the aperture 17. If a load is positioned in an unbalanced manner on the lid 37 the side of the lid that is opposite to the side where the load is positioned wants to move in a direction away from the shoulder 16. However, the sill 49 on the lug 45 located on this side of the lid engages the top wall 21 of the aperture 17 and prevents the lid 37 from moving in a direction away from the shoulder and prevents the lid from tipping. Thus, the lugs 45 act to maintain the lid 37 on the shoulder 16 and to prevent any portion of the lid from moving in a direction away from the shoulder. This is a safety feature that prevents the lid from tipping and greatly reduces the change of anyone being injured if they inadvertantly step on the lid 37.

The lugs 45 also make it more difficult to remove the lid from the sump well 1. To remove the lid from the sump well as it is necessary to deflect the ring 15 over the sills 49 of the lugs 45 before the lid 37 can be moved in a direction away from the shoulder 16. This requires more strength and dexterity than most children possess and this further reduces the change of a small child removing the lid 37 and falling into the collection cavity of the sump well.

Figure 6:
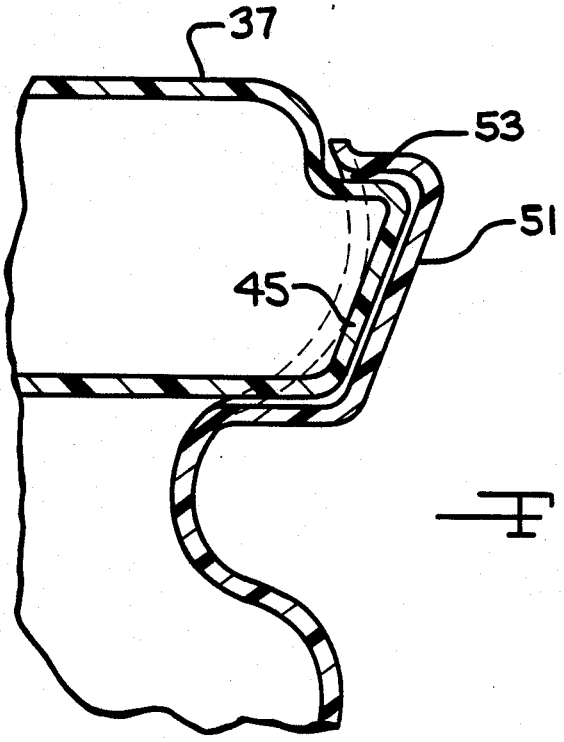
FIG. 6 is a cross-sectional view taken along line 6—6 in FIG. 5.

FIGS. 5 and 6 show another embodiment of the safety lid of the present invention. In this embodiment, a plurality of recess pockets 51 are molded into the ring 15 on the second end of the sump well. The recess pockets are positioned to be in alignment with the lugs 45 on the lid 37 and the recess pockets form apertures or openings 53 in the ring 15 that are designed to accept the lugs 45. The recess pockets and lugs cooperate and function in essentially the same manner as the lugs and apertures 17 previously described. However, the recess pockets 51 totally enclose the lugs 45 and help to reduce the chance of pinching a finger or hand when installing the lid 37. Also, the recess pockets eliminate the open apertures through the ring 15. Sumps are frequently installed in a basement before the concrete floor is poured. When the floor is poured the concrete is positioned around the second end 5 and the ring 15 of the sump. If there are apertures through the ring the concrete can close these apertures and even enter into the collection cavity 4. The recess pockets 51 provide an enclosed chamber for the lugs 45 but the chamber is closed on the outer periphery of the sump well. Thus, concrete for a basement floor can not enter and close the chamber defined by the recess pockets and concrete cannot flow through the recess pockets into the collection cavity 4.

The above description is given for the sake of explanation. Various modifications and substitutions other than those cited can be made without departing from the scope of the invention as defined by the following claims.

What we claim is:

1. A safety lid for a sump well comprising:

a container made of a plastic material having sidewalls and a bottom that define a cavity, said cavity of said container having an opening on the end that is spaced apart from said bottom;

a shoulder located in said container adjacent said opening, said shoulder extending around at least a portion of said periphery of said container said shoulder being disposed substantially parallel to said opening;

a ring formed by said sidewalls of said container, said ring extending between said shoulder and said opening, said ring being disposed substantially perpendicular to said shoulder and said opening;

a plurality of apertures positioned in said ring adjacent said opening; said apertures positioned between said shoulder and said opening;

a lid for positioning in said opening to close said container, said outer periphery of said lid substantially conforming to the periphery of said opening, said lid engaging and being supported by said shoulder;

a plurality of lugs positioned on said outer periphery of said lid, said lugs being disposed to be in alignment with and to extend into said apertures in said ring when said lid is supported on said shoulder, said lugs projecting away from said outer periphery of said lid, said lugs having a cam surface being disposed at an angle with respect to the outer periphery of said lid, said cam surface diverging outwardly as said cam surface advances away from said shoulder, said cam surface of said lugs causing said ring to expand radially when said lid is placed on said container, said ring returning to its original size when said lugs are in alignment with and extend into said apertures, said cam surface terminating in a sill, said sill being disposed substantially parallel to said shoulder, said sill of said lugs engaging said edge of said apertures that is spaced apart from said shoulder to prevent said lid from moving away from said shoulder and to keep said lid from tipping.

2. The lid of claim 1 wherein a pocket is positioned around each of said apertures in the periphery of said ring, said pocket enclosing the side of said aperture that is spaced from said collection cavity, said pocket defining a recess that is large enough to accept said lugs.

3. The lid of claim 2 wherein a plurality of lugs are positioned on the outer periphery of said lid, said lugs projecting away from said lid, said lugs positioned to be in alignment with and to extend into said apertures and pockets in said container.

4. The lid of claim 1, wherein said container is substantially cylindrical and said opening is substantially circular.

5. The lid of claim 4, wherein said lid is substantially circular and has a diameter that is slightly smaller than the diameter of said circular opening so that said lid fits in said opening and is adjacent said inner periphery of said opening.

6. The lid of claim 5, wherein said shoulder extends around the inner periphery of said container adjacent said opening, said shoulder being positioned to engage said lid and to hold said lid in said opening, said shoulder having a diameter that is smaller than the diameter of said lid.

* * * * *